US010513925B2

(12) United States Patent
Galler et al.

(10) Patent No.: US 10,513,925 B2
(45) Date of Patent: Dec. 24, 2019

(54) EXPENDABLE SUPPLY SYSTEM FOR UNDERGROUND DRILLING

(71) Applicant: SANDVIK INTELECTUAL PROPERTY AB, Sandviken (SE)

(72) Inventors: Thomas Galler, Katsch/Mur (AT); Martin Kuppper, Velden am Worthersee (AT); Andreas Bischof, Obdach (AT)

(73) Assignee: SANDVIK INTELLECTUAL PROPERTY AB, Sandviken (SE)

( * ) Notice: Subject to any disclaimer, the term of this patent is extended or adjusted under 35 U.S.C. 154(b) by 91 days.

(21) Appl. No.: 15/545,261

(22) PCT Filed: Jan. 21, 2015

(86) PCT No.: PCT/EP2015/051120
§ 371 (c)(1),
(2) Date: Jul. 20, 2017

(87) PCT Pub. No.: WO2016/116148
PCT Pub. Date: Jul. 28, 2016

(65) Prior Publication Data

US 2018/0016899 A1 Jan. 18, 2018

(51) Int. Cl.

| | |
|---|---|
| ***E21B 19/14*** | (2006.01) |
| ***E21D 20/00*** | (2006.01) |
| ***E21B 19/20*** | (2006.01) |
| ***E21B 19/24*** | (2006.01) |
| *E21B 44/00* | (2006.01) |

(52) U.S. Cl.
CPC ..... *E21D 20/006* (2013.01); *E21B 19/14* (2013.01); *E21B 19/146* (2013.01); *E21B 19/20* (2013.01); *E21B 19/24* (2013.01); *E21B 44/005* (2013.01)

(58) Field of Classification Search
CPC ..... E21D 20/006; E21B 19/14
USPC ..... 175/52
See application file for complete search history.

(56) References Cited

U.S. PATENT DOCUMENTS

| | | | | |
|---|---|---|---|---|
| 6,394,192 | B1 * | 5/2002 | Frazer | E21B 7/124 175/20 |
| 6,413,019 | B1 | 7/2002 | Coombs et al. | |
| 6,581,698 | B1 | 6/2003 | Dirks | |
| 2008/0011516 | A1 * | 1/2008 | Piipponen | E21B 7/20 175/57 |

(Continued)

FOREIGN PATENT DOCUMENTS

| | | | |
|---|---|---|---|
| DE | 3738116 | A1 | 5/1989 |
| DE | 19837692 | A1 | 3/2000 |

(Continued)

*Primary Examiner* — Taras P Bemko
(74) *Attorney, Agent, or Firm* — Corinne R. Gorski

(57) ABSTRACT

A manipulator for providing drilling expendables to a drill head of an underground drill rig includes a gripper that is arranged to selectively grip and release the drilling expendables and to move the gripper between a first position facing a supply magazine and a second position facing the drill head. The manipulator is also arranged to automatically take and return expendables to and from the magazine and drill head. A supply device provides the expendables to a drill head of an underground drill rig having the supply magazine, and to an underground drill rig, as well as an underground mining vehicle.

16 Claims, 5 Drawing Sheets

(56) References Cited

U.S. PATENT DOCUMENTS

| | | | | |
|---|---|---|---|---|
| 2010/0200297 | A1* | 8/2010 | Comacchio ..... | E21B 19/146<br>175/52 |
| 2014/0338973 | A1 | 11/2014 | Taylor et al. | |

FOREIGN PATENT DOCUMENTS

| | | | |
|---|---|---|---|
| GB | 2030492 | A | 4/1980 |
| RU | 95100579 | A1 | 4/1997 |
| WO | 2007129337 | A1 | 11/2007 |
| WO | 2010092236 | A1 | 8/2010 |

* cited by examiner

EXPENDABLE SUPPLY SYSTEM FOR UNDERGROUND DRILLING

RELATED APPLICATION DATA

This application is a § 371 National Stage Application of PCT International Application No. PCT/EP2015/051120 filed Jan. 21, 2015.

TECHNICAL FIELD

The invention relates to a manipulator for providing drilling expendables to a drill head of an underground drill rig. The invention further relates to a supply device for providing expendables to a drill head of an underground drill rag. Still further, the invention relates to an underground drill rig and an underground mining vehicle having a drill rig.

BACKGROUND OF THE INVENTION

In underground mining and construction, underground drill rigs are used for performing drilling operations of different types. One common field of use for underground drill rigs is to reinforce roof and/or wall sections with reinforcement material such as rebar bolts. For performing drilling operations, the underground drill rigs require a supply of drilling expendables. Despite all attempts to create safe working environments, underground mining still poses hazardous working conditions at times. The supply of drilling expendables to the drill rig presents potential safety risks when conducted manually. Furthermore, underground drill rigs are operated in increasingly narrow space confines.

It is therefore desirable to replace manual work for supplying drilling expendables to the drill rigs with mechanized work by providing manipulators which provide the drilling expendables in an at least partly mechanized fashion. However, in view of the narrow space confines in underground mining situations, previous attempts in the industry have not yet sufficiently met the demand for safe and at the same time space-saving solutions.

SUMMARY OF THE INVENTION

It has thus been an object of the invention to arrive at an improved manipulator for providing drilling expendables to a drill head of an underground drill rig. It has been a further object of the invention to arrive at an improved supply device for providing expendables to a drill head of an underground drill rig, an improved underground drill rig, in particular roof bolter, and an underground mining vehicle, in particular an improved mobile bolter, bolter, miner or road header.

In particular, it has been an object of the invention to provide a manipulator, supply device, underground drill rig, and underground mining vehicle of the aforementioned type which allow for improved safety in use while allowing for a space-saving design.

According to a first aspect, the invention suggests a manipulator for providing drilling expendables to a drill head of an underground drill rig. The manipulator has a gripper, said gripper being adapted to selectively grip and release the drilling expendables, and said manipulator being adapted to move the gripper between a first position facing a supply magazine, said supply magazine holding the expendables, and a second position facing the drill head, wherein the manipulator is adapted to automatically take the expendable from the magazine and to return it thereto, and further adapted to automatically insert the expendable into the drill head and to remove it therefrom. With respect to the invention, "automatic" is understood to mean that the manipulator is adapted to move by itself without manual intervention by a user, preferably in response to an initial user input.

In providing the automatic manipulator, the invention enables the supply of drilling expendables to the drill head of the drill rig in a hands-free manner which minimizes the risk of injury for operating personnel.

Preferably, the gripper is movable in a transverse direction between a retracted state and an extended state, wherein in the extended state, the gripper is positioned closer to the magazine than in the retracted state when in the first position, and positioned closer to the drill head than in the retracted state when in the second position. In one embodiment, when the gripper is in the extended state, it approaches or reaches a drilling expendable in the magazine or in the drill head.

It is particularly preferred that the manipulator comprises an extension mechanism for moving the gripper between the extended state and the retracted state, such as a scissor-type extension mechanism. The transverse movement of the gripper is considered beneficial with particular regard to the space requirement of the gripping procedure. By having the gripper move towards either the magazine or the drill head when in the respective position, it is in particular provided by the extension mechanism that the gripper does not have to move laterally and/or angularly in a sideways manner when travelling from the retracted state to the extended state and vice versa. Furthermore, the—preferably scissor-type—extension mechanism allows for space-saving design and is at the same time robust and easy to maintain.

With respect to the invention, the transverse direction is understood to be the direction substantially perpendicular or perpendicular to the drilling axis of the drill rig when the manipulator is installed on the drill rig.

In a further preferred embodiment, the manipulator comprises a translation mechanism for moving the gripper in a longitudinal direction. With respect to the invention, the longitudinal direction is understood to be the orientation of the drilling axis and refers to the state when the manipulator is installed on the drill rig.

The translation mechanism preferably comprises a slanted groove and a projecting member slidably engaging said groove, with either the groove or the projecting member being associated with the gripper. The slanted groove and the engaging relationship between the gripper and the groove provide a precise and at the same time robust and space-saving guiding system for moving the gripper from the first position facing the supply magazine towards the second position facing the drill head and vice versa. The projecting member preferentially is a guide pin or guide roller.

In a further preferred embodiment, the slanted groove is curved or angled with respect to the longitudinal direction. By providing the slanted groove in this manner, the translation mechanism is adapted to perform a sideways movement in addition to the movement component in the longitudinal direction without additional actuation means being necessary. This facilitates the electronic control and thus the automation of the manipulator movement. The slanted groove may, in preferred embodiments, cover a portion of the longitudinal travel of the translation mechanism, or extend substantially entirely along the longitudinal travel of the translation mechanism.

The groove preferably defines a winding path such that in a first portion in the longitudinal direction, the gripper is in the first position facing the supply magazine, and in the second portion in the longitudinal direction, the gripper is in the second position facing the drill head.

In a further preferred embodiment, which is alternatively or additionally also a separate aspect of the invention, a supply device for providing expendables to a drill head of an underground drill rig is suggested, the supply device comprising a manipulator according to anyone of the preferred embodiments described hereinbefore and hereinafter. Additionally or alternatively to the manipulator, the supply device comprises a supply magazine having a plurality of holders for drilling expendables, wherein each holder of the supply magazine preferably is adapted to accommodate one specific drilling expendable or adopts to differently-sized drilling expendables of the following types: drill steels, rebar bolts and resin cartridges. The term "drilling expendable" is also referred to as drilling consumable. Differently-sized drilling expendables are in particular understood to differ in regard to their cross-sectional diameter. A central benefit of the supply magazine is that it allows for very flexible allocation of the different types of drilling expendables. If each holder can accommodate each type of expendable, the supply magazine and with it the supply device is suited for multiple purposes in underground mining. While a preferred use of the supply device having the aforementioned supply magazine is the roof bolting, alternative uses, which for example require the supply magazine to hold drilling steels of different sizes, exclusively are also possible without having to modify the architecture of the supply magazine and supply device.

In a preferred embodiment, each holder comprises one or more elastically deformable spring clips. In particular, the spring clips are adapted to deform such that the clearance between the opposing portions holding the expendables varies upon deformation. The spring clips consequently allow for reliable holding of the differently-sized drilling expendables in a snap-fit fashion, and at the same time remain tolerant when it comes to positioning and orienting the gripper and the supply magazine relative to each other. Even when the gripper and/or the respectively associated holder of the supply magazine are not in the exactly designated orientation, the deformation of the spring clips will still allow for the gripper to successfully remove the expendable from the holder, and/or for the holder to reliably receive and hold the expendable from the gripper.

In a preferred embodiment, the supply magazine has an elongate shape, the elongate shape being defined by a wide side and a narrow side. It is particularly preferred that the supply magazine and manipulator are oriented with the manipulator facing the narrow side of the supply magazine. The elongate shaping of the supply magazine and its orientation with the narrow side facing the manipulator allows for further space reduction in a plane perpendicular to the drilling direction. Preferably, the supply magazine and its holders are oriented such that the drilling expendables are held substantially parallel or parallel to the drilling direction. Due to the elongate shape, the supply magazine essentially has the shape of an oval or oblong carousel.

The supply magazine preferentially comprises a chain, said chain having a plurality of chain links comprising respectively at least one of the holders. In a particularly preferred embodiment, a chain link comprises exactly one holder. In a preferred embodiment, the chain comprises alternating inner and outer chain links. It is further preferred if every other chain link has exactly one holder, such as every outer chain link.

Using a chain as the base structure for the drilling expendable holders of the supply magazine has several advantages. It firstly allows for a very sturdy design and secondly allows for the use of a chain drive which can be controlled to exactly stop at predetermined positions. This enables the drive to very precisely orient the holders, which in term facilitates the exchange of drilling expendables between the manipulator and the supply magazine.

In a preferred embodiment, the supply magazine is driven by a motor, said motor preferably being an electric motor. In a further preferred embodiment, said motor is coupled to the chain through a Geneva drive. A particular advantage in the context of the invention is that the Geneva drive very easily and mechanically translates the rotation of the motor into a stepped movement of the chain.

In a preferred embodiment, each holder on a chain link defines one index position. Preferably, the Geneva drive and the chain cooperate such that one full rotation of the motor causes the Geneva drive to move by one rotational step, which in turn causes the chain to move by one index position.

The supply device preferably comprises a control unit, which is adapted to drive the chain such that in response to a user input, a desired index position is moved into a transfer position, said transfer position being oriented facing the manipulator. Preferably, the transfer position is oriented such that when the gripper is in the first position, the gripper approximates the holder which is in the transfer position merely by extending from the retracted state into the extended state without lateral movement being necessary. Accordingly, the transfer position is preferably the position closest to the first position of the gripper.

In a further preferred embodiment, the chain is a first chain, and the supply magazine further comprises a second chain spaced-apart from and preferably parallel to the first chain. The first chain and second chain are preferably synchronized, for example mechanically coupled, such that one common drive is sufficient to drive both chains. This enables each drill and expendable to be held by two spaced-apart holders which are synchronously driven. This also ensures that all drilling expendables are held in parallel during use of the supply magazine, further facilitating the exchange of drilling expendables between the gripper and the supply magazine.

An actuator for actuating a jaw of the gripper or actuating the scissor-type extension mechanism, or actuating the translation mechanism or driving the gripper in the longitudinal direction, can be such as cylinder, chain drive, spool, cable, rack and pinion, hydraulic, pneumatic and/or electromechanical actuator.

In a further preferred embodiment, the supply magazine comprises a sensor for recognizing a reference chain link. In order to operate the supply device in a fully automatized manner, the system needs to be given information on which holder on the chain holds which type of drilling expendable. Designating one chain link as a reference chain link allows the control unit to determine, at any point in time, which type of drilling expendable is in the transfer position, or whether an empty holder is in the transfer position. Since the chain has a defined number of chain links, it also has a defined number of stops or index positions which together make up a full rotation of the chain. By having the sensor recognize the reference chain link, it is enabled to program the control unit to automatically move the supply magazine into a predetermined index position, and further to control the manipulator such that the gripper withdraws a predetermined drilling expendable upon user input from the magazine, or inserts a used drilling expendable previously taken from the drill head back into the supply magazine.

In a further preferred embodiment, the supply magazine comprises a sensor for recognizing the chain position. Preferably, this type of sensor may be a rotation counter for the motor coupled with the Geneva drive, wherein, as mentioned above, one full rotation of the motor is preferably representative of moving the Geneva drive—and thus the chain—one index position further. Preferably, the size (number of storage positions) of the magazine is variable depending on the equipment used.

The control unit is preferably adapted to operate also the manipulator in response to user input. Alternatively, the supply device may comprise a separate control unit for operating the manipulator.

In a preferred embodiment, the control unit is adapted to do at least one of the following:

control the gripper to grip and release the drilling expendables, and to move the gripper between the first position and the second position;

control the manipulator to take the expendable from the magazine and return it thereto, and to insert the expendable into the drill head and remove it therefrom;

control the manipulator, preferably the extension mechanism of the manipulator, to move in the gripper the transverse direction between the retracted and the extended state, wherein in the extended state, the gripper is positioned closer to the magazine than in the retracted state when in the first position, and positioned closer to the drill head than in the retracted state when in the second position; and/or control the translation mechanism for moving the gripper in the longitudinal direction.

It is further preferred that the control unit is adapted to do at least one of the following:

in response to a first user input, perform at least one of: moving the manipulator into the first position, taking the drilling expendable from the magazine, moving the manipulator into the second position, and inserting the drilling expendable into the drill head;

in response to the first user input or at least one further user input, perform at least one of: moving the manipulator into the second position, taking the drilling expendable from the drill head, and/or moving the manipulator into the first position, and inserting the drilling expendable into the magazine; and/or in response to the first user input or at least one further user input, move a desired index position of the chain into the transfer position for providing an expendable to the gripper or for receiving an expendable from the gripper.

In a further aspect, the invention suggests an underground drill rig, in particular a roof bolter, comprising: a drill head adapted to receive and rotatably drive drilling expendables, a manipulator according to any one of the preferred embodiments described herein above, and/or a supply device according to any one of the preferred embodiments described hereinabove. The underground drill rig benefits from and makes use of the same advantages and technical effects as discussed hereinabove with regard to the manipulator and the supply device. Accordingly, reference is made to the description of these units hereinabove.

In a further aspect, the invention suggests an underground mining vehicle, in particular a mobile bolter, bolter miner or road header, comprising a drill rig. The drill rig is formed in accordance with the preferred embodiments described hereinabove. Also, with regard to the underground mining vehicle, it shall be understood that the vehicle has the same preferred embodiments and benefits from the advantages and technical effects described hereinabove with regard to the manipulator and supply device of the invention, which is why reference is made to the statements hereinabove.

According to a further aspect, the invention suggests a method of controlling an underground drill rig. The method comprises the steps of:

c) moving a manipulator into a first position facing the supply magazine, d) taking a first expandable from the magazine with a gripper of the manipulator, e) moving the manipulator into a second position, facing the drill head of the drill rig, and f) inserting the first expendable into the drill head with the gripper.

Optionally, the method further comprises the steps of a) providing drilling expendables, in particular a plurality of differently-sized drilling expendables of the following types: drill steels, rebar bolts, and resin cartridges; on a supply magazine, and/or b) moving the supply magazine into a first index position.

Preferably, steps a) and/or b) are elected prior to step c).

It is further preferred if one, several or all of the steps b) to e) are performed in response to a first user input. In particular, these steps are preferably performed in response to exactly one first user input.

In the method, the step of moving the manipulator preferably comprises moving the manipulator in a transverse direction between a retracted state and an extended state, preferably by actuating a scissor-type extension mechanism. This is preferably done in between steps c) and d) and/or in between steps e) and f).

Alternatively, or additionally, moving the manipulator comprises moving the gripper, preferably by actuating a translation mechanism, in a longitudinal direction.

In a further preferred embodiment, the method comprises steps of:

g) taking the first expendable from the drill head with the gripper, h) moving the manipulator from the second position into the first position, and i) inserting the first expendable into the supply magazine with the gripper, wherein one, several or all of the steps f) to h) are performed in response to the first user input or in response to at least one further user input. Alternatively or additionally, the method of this embodiment comprises the steps of:

j) moving the supply magazine to a second index position, and k) repeating one, several or all of steps d) to i) for a second expendable provided in the second index position, wherein one or both of steps j) and k) are performed in response to the first user input or at least one further user input.

Alternatively, or additionally, the method comprises the steps of:

l) moving the supply magazine to a third index position, and m) repeating one, several or all of steps d) to i) for a third extendable provided in the third index position, wherein one or both of steps l) and m) are performed in response to the first user input or at least one further user input.

In a particularly preferred embodiment of the method, all of steps a) to m) are carried out in response to the first user input. This allows for a one-button operation of the underground drill rig and accordingly allows for a one-button bolting operation, wherein after positioning the drill rig and the desired orientation towards the intended bolting spot, the drill rig automatically takes a drill steel from the supply magazine with the manipulator, inserts it into the drill head, drills a bore and removes the drill steel from the drill head, takes a present cartridge from the supply magazine, inserts it into the bore and also takes a rebar bolt from the supply magazine and inserts it into the bore, using the resin of the resin cartridge to bind and solidify the rebar bolt in the bore.

In a further aspect, the invention suggests the use of a manipulator to provide drilling expendables to a drill head of an underground drill rig, wherein the manipulator is formed in accordance with any one of the preferred embodiments described hereinabove.

In a further aspect, the invention suggests the use of a supply device to provide drilling expendables in the form of drill steels, rebar bolts and resin cartridges to a drill head of an underground drill rig, said supply device being formed in accordance with any one of the preferred embodiments described hereinabove.

It shall be understood that the manipulator, the supply device, the underground drill rig, the underground mining vehicle, the method described hereinabove and the use described hereinabove have similar and/or identical preferred embodiments.

It shall further be understood that a preferred embodiment of the present invention may also be any combination of the dependent claims or above described embodiments with the respective independent claim.

BRIEF DESCRIPTION OF DRAWINGS

A preferred embodiment will be described hereinafter by way of example with reference to the attached figures, in which.

DETAILED DESCRIPTION

Figure 1:
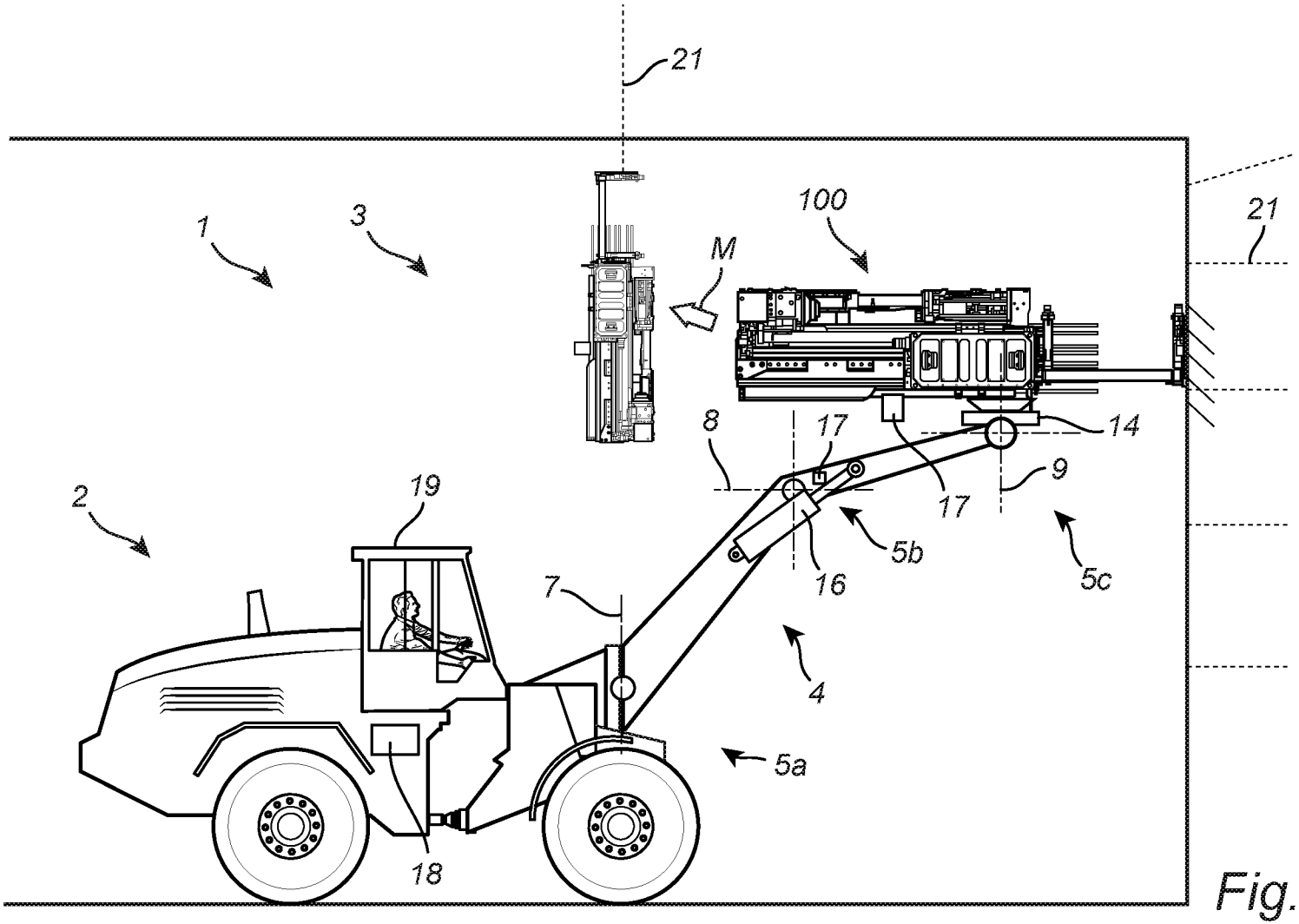
FIG. 1 shows a schematic representation of a mining vehicle according to a preferred embodiment, FIGS. 2*a, b, c* show schematic representations of a supply device according to a preferred embodiment in a first operational state, FIGS. 3*a, b, c* show schematic representations of the supply device of FIGS. 2*a, b, c* in a second operational state.

FIG. 1 shows an example of an underground mining vehicle 1 which may for example be a mobile bolter, bolter miner or roadheader. The vehicle 1 is depicted on a working site 3. It comprises a movable carrier 2. The vehicle 1 comprises a boom 4, and may optionally comprise more than one boom. The boom 4 comprises several joints 5 *a, b, c* which allow for rotary movement of the boom about the respective axes 7, 8, 9 and 14.

Also, other rotational arrangements are possible depending on the designated use of the underground mining vehicle 1.

The boom 4 is mounted with a proximal end towards the carrier 2 and comprises at its distal end a drill rig 100. The drill rig 100 is built in accordance with a preferred embodiment described herein. In particular:

The drill rig 100 is adapted to drill holes 21 into a side wall or roof portion on the working site 3. At least one, and preferably a plurality of actuators 16 (only one shown) are mounted to the boom 4 for effecting an adjustment of the boom 4 and the drill rig 100 to achieve a desired orientation for drilling the holes 21. For bolting operations, which are typically performed to the roof portion of the working site 3, the boom 4 and with it the drill rig 100 may be moved from the shown orientation into an orientation as indicated by arrow M and the (downsized) drill rig shown in the center top portion of FIG. 1.

Preferably, the boom 4 comprises one or more sensors 17, measuring devices or other position detection means for determining the position of the boom 4.

The vehicle comprises a control unit 18 which is adapted to control the boom 4. In a preferred option, the control unit 18 may also be adapted to control functions of the drill rig 100 in embodiments where the drill rig 100 does not comprise a separate dedicated control unit for its operation.

The vehicle 1 further comprises an operator cabin 19 which houses control means for operating the mining vehicle 1. Preferably, also control means for operating the drill rig 100 are located inside the operator cabin 19.

A preferred embodiment of the drill rig 100 is explained with reference to FIGS. 2 *a-c* and 3 *a-c* hereinafter.

Figure 2A:
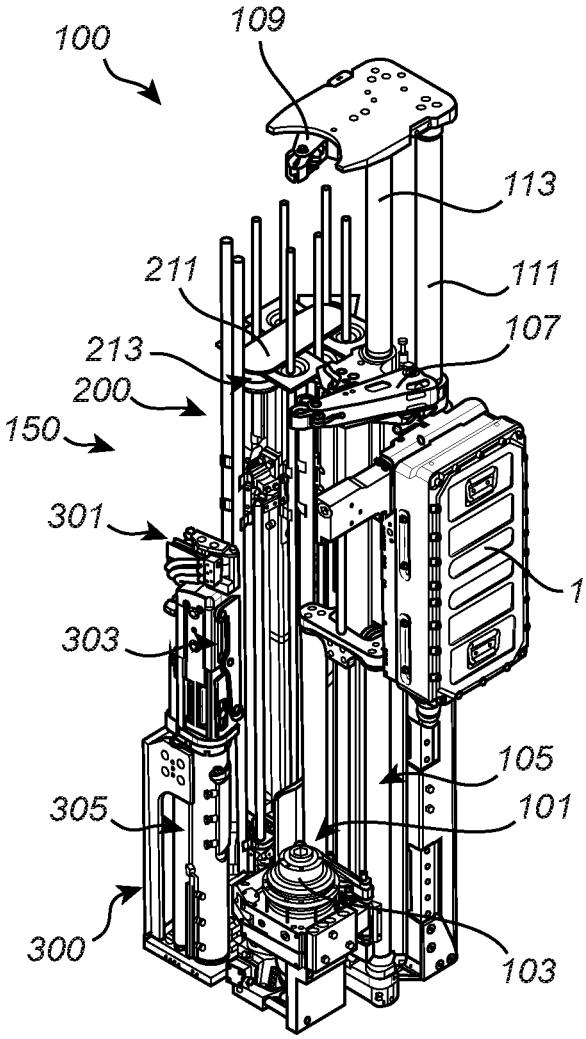
Figure 2B:
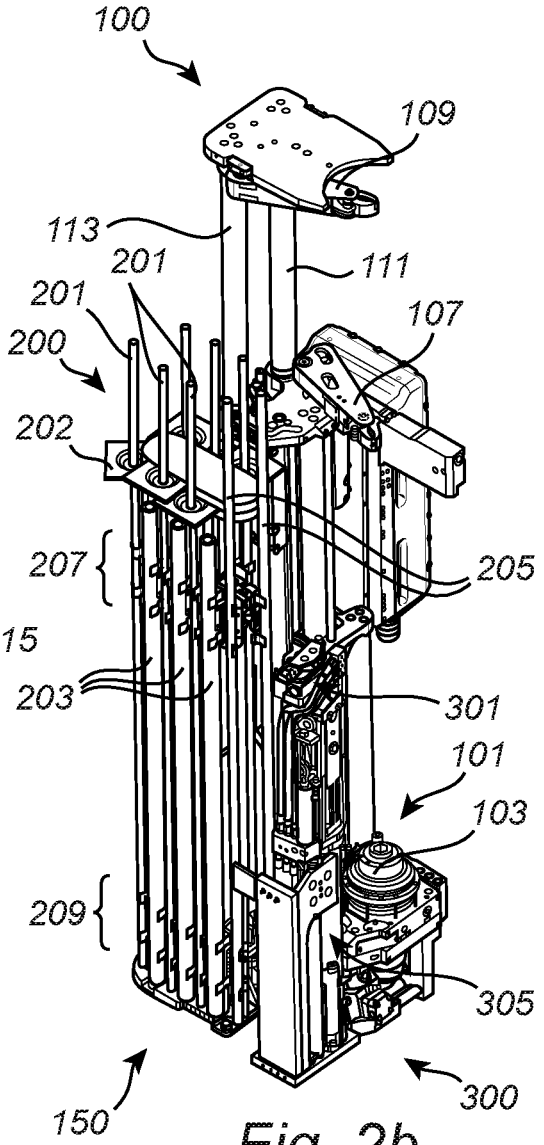

FIGS. 2 *a-c* show the drill rig 100 in a first operational state. The drill rig 100 comprises a drill head 101 adapted to receive and rotationally drive drilling expendables 201, 203, 205 such as drill steels, rebar bolts and resin cartridges. The drill head 101 comprises a drive chuck 103. The drill head 101 is slidably mounted on a carriage 105.

The drill rig 100 comprises a first drill guide 107 which is mounted on a guide rail 111. In a preferred option, the drill rig 100 further comprises a second drill guide 109 which is mounted to a second guide rail 113. The first and/or second drill guides 107, 109 are adapted to stabilize the drilling expendable for proper aligning in the drive chuck 103.

The main functions of the drill rig 100 are preferably controlled through a hydraulic and electronic control unit (HECU) 115.

The drill rig 100 comprises a supply device 150. The supply device 150 comprises a supply magazine 200 and a manipulator 300.

Figure 4:
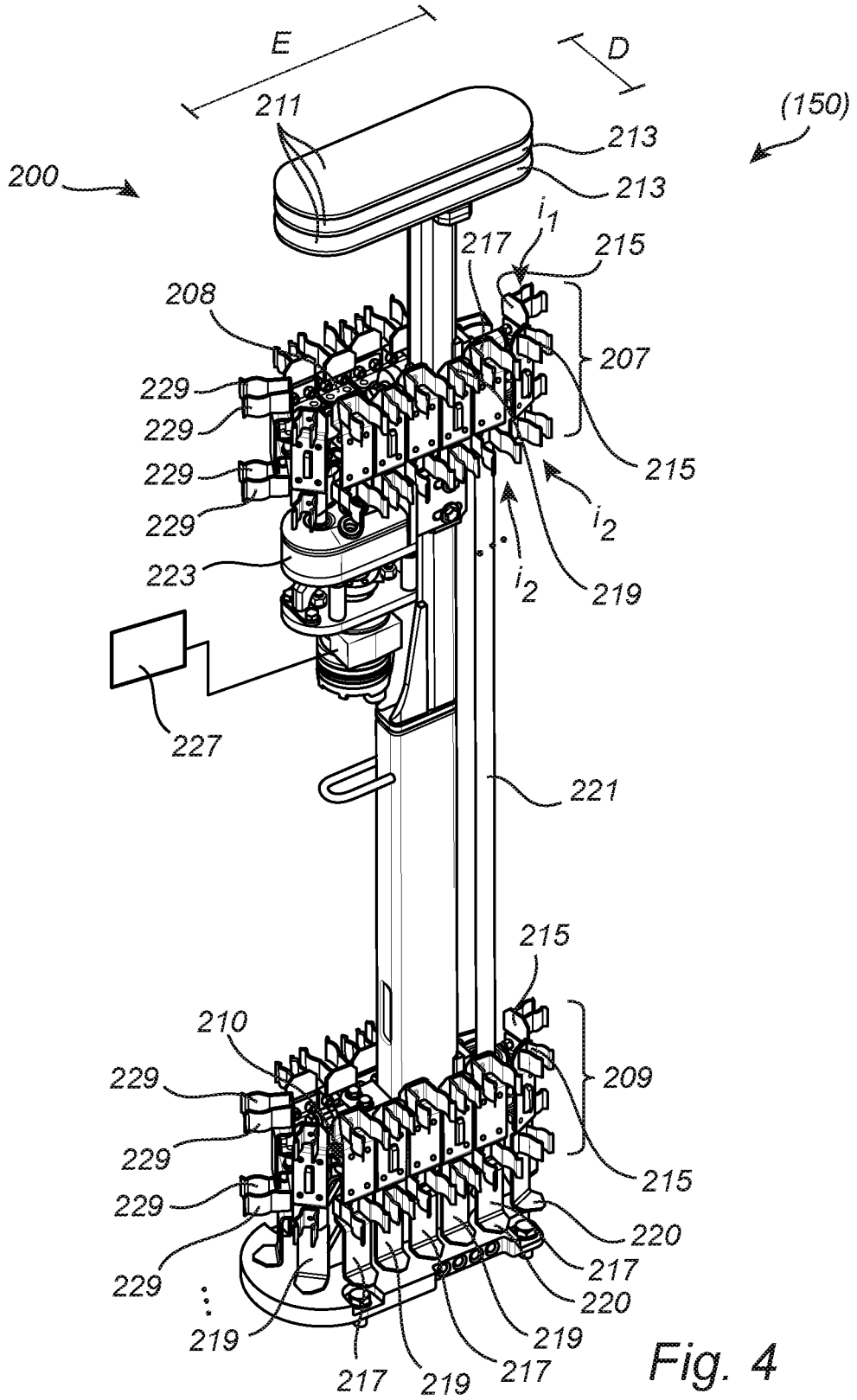
FIG. 4 shows a partial representation of a supply device according to a preferred embodiment.

The supply magazine 200, which is explained in more detail with respect to FIG. 4, carries a plurality of drilling expendables, namely a plurality of rebar bolts 201 having washer plates 202, a plurality of resin cartridges 203 and a plurality of drill steels 205. The drilling expendables 201, 203, 205 are held in place in the supply magazine 200 by holders in a first holding section 207 and second holding section 209. The drilling expendables 201, 203, 205 are held preferably parallel with respect to each other and parallel with respect to the longitudinal direction or drilling axis of the drill head 101.

The washer plates 202 of the rebar bolts 201 are slightly held in correspondingly shaped slots 213 formed in between a plurality of head plates 211. When a rebar bolts 201 is removed from the supply magazine 200, the washer plate 202 will slight down towards the drill head 101.

The manipulator 300 comprises a gripper 301 which is adapted to selectively grip and release the drilling expendables. The gripper 301 is adapted to be moved in a transverse direction with respect to the drilling axis of the drill head 101 between a retracted state and an extended state, wherein in the state depicted in FIGS. 2 *a-c*, the gripper 301 is in the retracted state. The transverse movement is accomplished by an extension mechanism, which in the depicted embodiment exemplarily is a scissor-type extension mechanism.

The gripper 301 is moveable in a longitudinal direction, parallel to the drilling axis of the drill head 101, wherein the movement in the longitudinal direction is governed by a translation mechanism 305 which may for example comprise an electromagnetically, pneumatically or hydraulically actuated piston. As can be seen in particular in FIG. 2*c*, the drilling expendables 201, 203, 205 of the supply magazine 200 are held spaced apart from each other wherein each holding position for one drilling expendable 201, 203, 205 defines one index position i (cf. FIG. 4). One of the index positions i is located in a transfer position T facing the manipulator 300. When in the depicted orientation, the gripper 301 of the manipulator is adapted to approximate and grab the drilling expendable currently in the transfer position T.

Figure 2C:
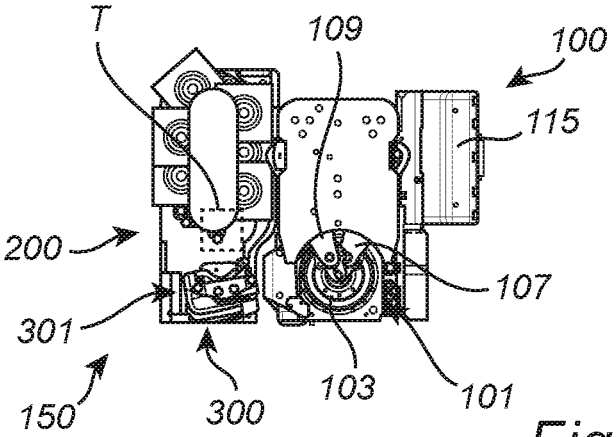
Figure 3A:
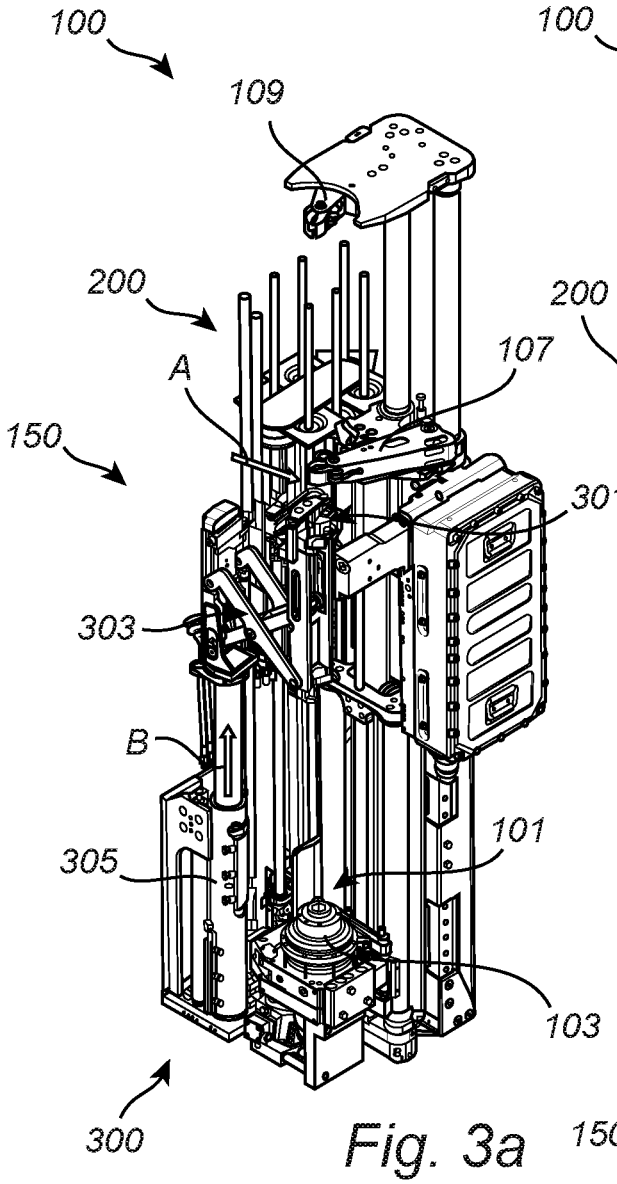
Figure 3B:
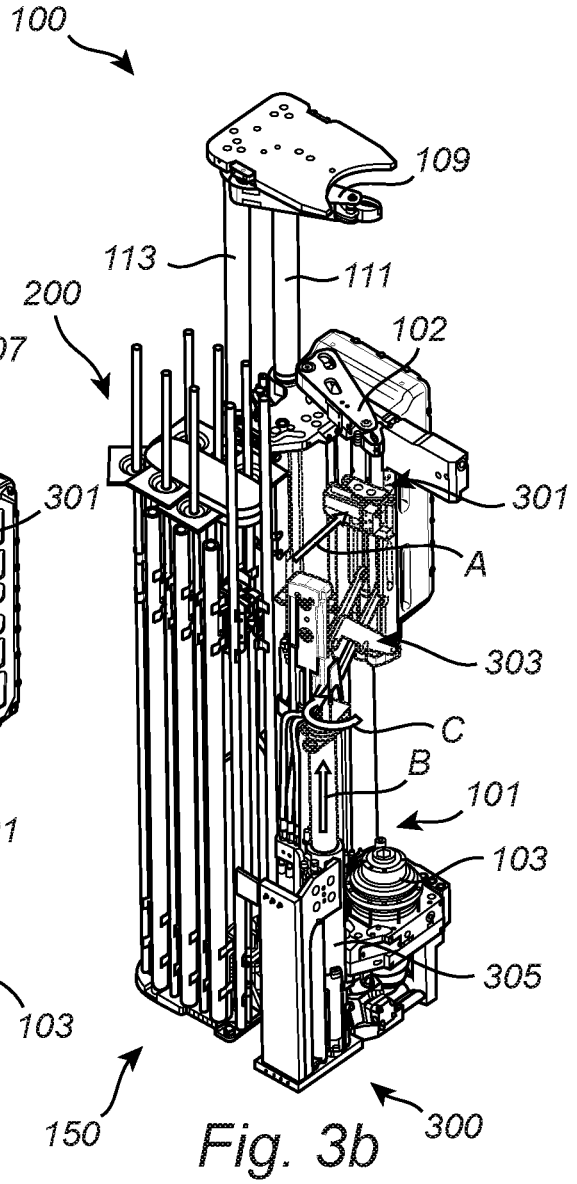

The actuation mechanism of the manipulator 300 is best described by comparing the first operational state shown in FIGS. 2 *a-c* with the second operational state shown in FIGS. 3 *a-c*. The gripper 301 has been moved from its retracted state shown in FIG. 2 *a-c* into the extended state in the direction of arrow A by extending the extension mechanism 303. Furthermore, the gripper 301 has been moved in the longitudinal direction as indicated by arrow B due actuation of the translation mechanism 305. Furthermore, the gripper 301 in FIGS. 3 *a-c* is no longer facing the magazine, but additionally been rotated as indicated by arrow C and now faces the drill head 101. In particular, the gripper is oriented such that upon extension in the direction of arrow A, the drilling expendable—if inserted in the gripper—would now be coaxially aligned with the drilling axis of the drill head 101. The drilling expendable could in this position be taken and held by the drill guides 107, 109 and/or inserted into the drive chuck 103.

FIG. 4 shows in more detail the supply magazine 200 which forms a part of the supply device 150. The supply magazine 200 comprises a plurality of holders 215, 217, 219. In the depicted embodiment, the holders 215 are particularly adapted and designed to hold drill steels 205. In particular, the holders 217 are adapted to hold resign cartridges 203. In particular, the holders 219 are adapted to hold rebar bolts 201. According to a further preferred embodiment, all holders may also be formed equally such that they are adapted to hold each type of drilling expandable.

The supply magazine 200 comprises a first chain 208 which carries a plurality of holders 215, 217, 219 in a first holding section 207. Furthermore, the supply magazine 200 comprises a second chain 210 carrying a second set of the holders 215, 217, 219 in a second holding section 209. The first and second chain 208, 210 are preferably synchronized by a coupling rod 221. The holders 215, 217, 219 in the second section 209 additionally comprise base shoulders 220 which act as a standing support for the drilling expendables.

The supply magazine 200 further comprises a Geneva drive 223 which is coupled on the one hand side to the first chain 208 and on the second side to an electric motor 225.

The holders define a plurality of index positions $i_1$, $i_2$, $i_3$ and so forth. Preferably, the supply magazine 201 cooperates with a sensor 227 which is adapted to recognize, for example by monitoring the rotations of the electric motor the index position I which is currently in the transfer zone T (cf. FIG. 2*c*, 3*c*).

Figure 3C:
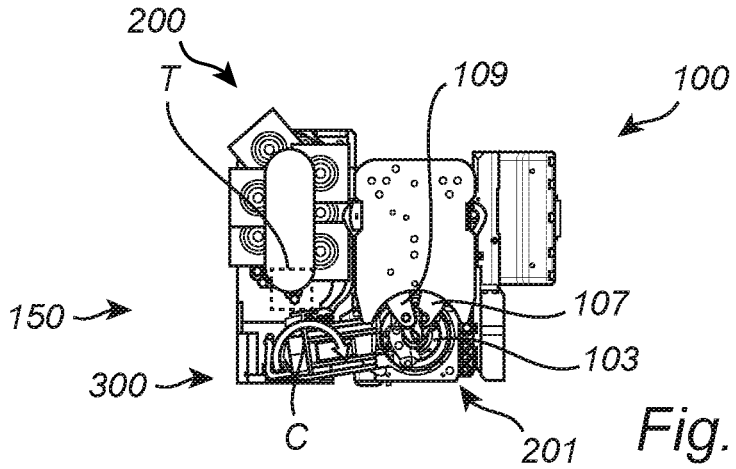

The supply magazine 200 comprises an elongate—or oblong—shape, having a first width D and a second with E perpendicularly to the first width D, wherein the second width E is larger than the first width D, making the side of the supply magazine 200 with width D the narrow side. Preferably, the supply magazine 200 is oriented as shown in FIGS. 2*c* and 3*c* such that the narrow side (with the first width D) faces the manipulator 300. By doing so, a very compact footprint in the orientation shown in FIGS. 2*c* and 3*c* is achieved. Said orientation is in a plane perpendicular to the drilling axis of the drill head 101.

Each holder 215, 217, 219 of the supply magazine 200 comprises a plurality of spring clips 229 which are elastically deformable for receiving, holding and releasing against a retention force the drilling expendables 201, 203, 205.

Figure 5:
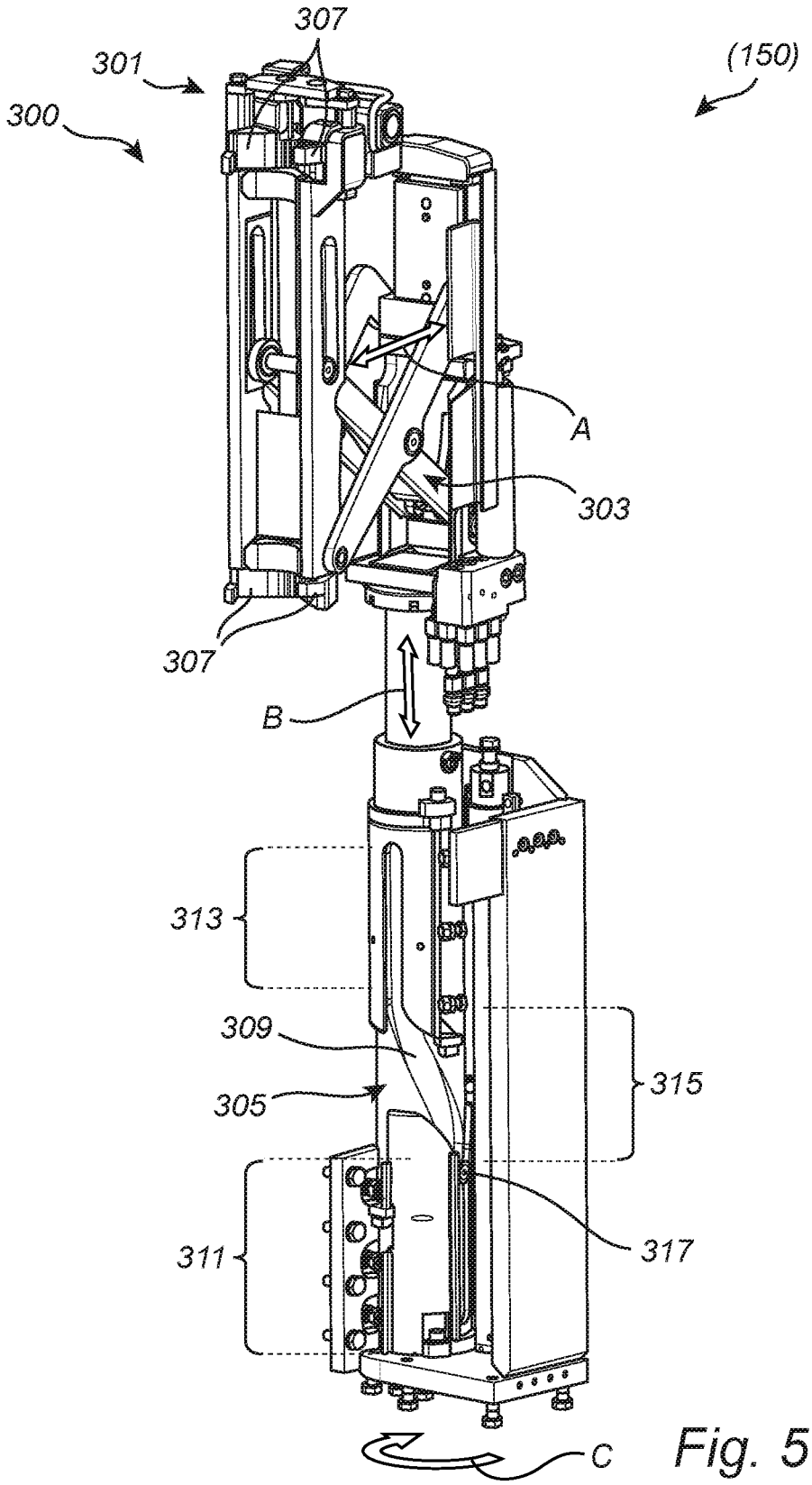
FIG. 5 shows a further partial representation of a supply device according to a preferred embodiment.

FIG. 5 gives a more detailed overview of the manipulator 300 which forms part of the supply device 150.

The manipulator 301 comprises a pair of clamps 307 which may for example be actuated in pneumatic, hydraulic or electromagnetic manner. The clamps 307 are preferably aligned such that they hold the drilling expendable in a direction parallel to the drilling axis of the drill head 101 when assembled on the drill rig 150.

The extension mechanism 303 is adapted to move, in particular retract or extend, the gripper 301 in the direction of arrow A.

In FIG. 5, the translation mechanism 305 is shown partly extended in the direction of arrow B. As can be seen in the lower half of FIG. 5, the translation mechanism 305 comprises a slanted groove 309. The gripper 301, for example by being mounted to a piston, is in engagement with a projecting member such as a guide pin 317 inside the slanted groove 309. By moving the gripper 301 upwards or downwards in the direction of arrow B, the guide pin 317 is forced along the slanted groove 309.

The slanted groove 309 comprises a first linear section 311 which preferably is oriented parallel to the drilling axis of the drill head 101, and a second linear section 313, which is preferably also oriented parallel to the drilling axis of the drill head 101. In between the first and second linear sections 311, 313, the slanted groove 309 comprises a curved or angled section 315 which compensates an offset between the first and second linear sections 311, 313. When travelling through the curved or angled section 309, the gripper 301 is pivoted as indicated by arrow C in addition to the translational movement in the direction of arrow B. In the shown embodiment, the sections 311, 313, 315 are distributed substantially equal along the travel of the translation mechanism 305. In alternative embodiments, it is however also preferred if the curved or angled section 309 is larger or smaller than the linear sections 311, 313, or if the slanted groove consists exclusively of the curved or angled section 315 without any linear sections adjacent to it.

The invention also discusses an automatic operation of the supply device 150 for performing drilling, and in particular bolting operations with the drill rig 100. Preferably, the necessary functions are programmed into the control unit 18 of the mining vehicle 1 and/or the hydraulic and electronic control unit 115 of the drill rig 100. Preferably, drilling expendables 201, 203, 205 are provided in the respective holders 215, 217, 219 of the supply magazine 200. The supply magazine 200 is moved, by driving the electric motor 225, into a first desired index position. For withdrawing a drill steel from the supply magazine 200, for example index position $i_1$ is moved into the transfer position T. Next, the manipulator 300 is moved into its first position facing the supply magazine 200, as shown in FIG. 2 *a-c*. Then, the manipulator 300 is operated such that the gripper 301 extends into the extended state and the clamps 307 take hold of the drilling expendable, for example a drill steel. Next, the gripper 301 is moved into the retracted position for withdrawing the drilling expendable, e.g. drill steel 205, from the holder 215. Next, the gripper 301 is moved in the direction of arrow B by the translation mechanism 305. The guide pin 317 forces a pivoting movement around arrow C by sliding along the slanted groove 309. Alternately, after the guide pin 317 has travelled into the second linear section 313, the gripper 301 reaches the second position shown in FIGS. 3 *a-c*. There, the drilling expendable such as the drill steel is transferred into the drive chuck 103 and the drilling operation can be conducted.

Provided that the drill steel can be used again, it is then possible to perform the aforementioned steps in reverse order to place the drill steel 205 back into the supply magazine 200. Next, if a rebar bolt 201 shall be installed in the drill bar, the supply magazine 200 is moved such that a resin cartridge 203 is put into the transfer position T, for example by driving index position $i_3$ into the transfer position T.

Then, the same working steps of the manipulator are repeated for withdrawing the resin cartridge 203 from the supply magazine 200 and installing it in the drive chuck 103.

Likewise, the rebar bolt 201 can finally also be installed in the drill hole 21 while using the manipulator 300 analogously to the aforementioned procedure. These steps can preferably be enacted with separate user commands or, particularly preferred, with one single user command which leads to all steps of a bolting procedure being carried out automatically.

As has been explained herein above, the invention thus presents a safe and user friendly way of operating an underground drill rig 100 which is at the same time safe to use and can be installed in space-saving fashion on an underground mining vehicle 1.

The invention claimed is:

1. A manipulator for providing drilling expendables to a drill head of an underground drill rig, said manipulator comprising:

a gripper, said gripper being arranged to selectively grip and release the drilling expendables and to move between a first position facing a supply holding the expendables and a second position facing the drill head, wherein the manipulator is arranged to automatically take an expendable from the supply magazine, and to return the expendable thereto, insert the expendable into the drill head and to remove the expendable therefrom; and a translation mechanism arranged to move the gripper in a longitudinal direction, the translation mechanism including a slanted groove and a projecting member slidably engaging said groove, the groove or the projecting member being associated with the gripper.

2. The manipulator of claim 1, wherein the gripper is arranged to move in a transverse direction between a retracted state and an extended state, wherein in the extended state, the gripper is positioned closer to the supply magazine than in the retracted state when in the first position, and positioned closer to the drill head than in the retracted state when in the second position.

3. The manipulator of claim 2, further comprising an extension mechanism, such as a scissor-type, arranged to move the gripper between the extended state and the retracted state.

4. The manipulator of claim 1, wherein the groove defines a winding path such that in a first portion in the longitudinal direction, the gripper is in the first position facing the supply magazine, and in a second portion in the longitudinal direction, the gripper is in the second position facing the drill head.

5. A supply device for providing drilling expendables to a drill head of an underground drill rig, the supply device comprising:

a manipulator including a gripper, the gripper being arranged to selectively grip and release the drilling expendables and to move between a first position facing a supply magazine holding the drilling expendables and a second position facing the drill head, wherein the manipulator is arranged to automatically take a drilling expendable from the supply magazine and to return the drilling expendable thereto, and insert the drilling expendable into the drill head and to remove the drilling expendable therefrom, and a translation mechanism arranged to move the gripper in a longitudinal direction, the translation mechanism including a slanted groove and a projecting member slidably engaging said groove, the groove or the projecting member being associated with the gripper; and a supply magazine having a plurality of holders for the drilling expendables, wherein each holder of the supply magazine is arranged to accommodate differently-sized drilling expendables selected from the group of drill steels, rebar bolts, and resin cartridges.

6. The supply device of claim 5, wherein each holder includes one or more elastically deformable spring clips.

7. The supply device of claim 5, wherein the supply magazine has an elongate shape, the elongate shape being defined by a wide side and a narrow side, and wherein the manipulator faces the narrow side.

8. The supply device of claim 5, wherein the supply magazine includes a chain, said chain having a plurality of chain links comprising respectively at least one of the holders.

9. The supply device of claim 8, wherein each holder on a chain link defines one index position, and wherein the supply device is arranged to drive the chain such that in response to a user input, a desired index position is moved into a transfer position, said transfer position being oriented facing the manipulator.

10. The supply device of claim 8, wherein the chain is a first chain, and the supply magazine is a second chain spaced-apart from and preferably parallel to the first chain.

11. The supply device of claim 8, wherein the supply magazine includes a sensor for recognizing a reference chain link.

12. The supply device of claim 8, wherein the magazine includes a sensor for recognizing the index position.

13. The supply device of claim 5, wherein the supply magazine is driven by a motor, said motor cooperating with a Geneva drive.

14. The supply device according to claim 5, further comprising a control unit for operating the manipulator and/or the supply magazine depending on user input.

15. An underground drill rig, such as a roof bolter, the drill rig comprising:

a drill head arranged to receive and rotatably drive drilling expendables;

a manipulator including a gripper, the gripper being arranged to selectively grip and release the drilling expendables and to move between a first position facing a supply magazine holding the drilling expendables and a second position facing the drill head, wherein the manipulator is arranged to automatically take a drilling expendable from the supply magazine and to return the drilling expendable thereto, and insert the drilling expendable into the drill head and to remove the drilling expendable therefrom, and a translation mechanism arranged to move the gripper in a longitudinal direction, the translation mechanism including a slanted groove and a projecting member slidably engaging said groove, the groove or the projecting member being associated with the gripper; and a supply device including a supply magazine having a plurality of holders for the drilling expendables, wherein each holder of the supply magazine is arranged to accommodate differently-sized drilling expendables selected from the group of drill steels, rebar bolts, and resin cartridges.

16. An underground mining vehicle, such as a mobile bolter, bolter miner or roadheader, the mining vehicle comprising:

a drill rig comprising:

a drill head arranged to receive and rotatably drive drilling expendables;

a manipulator including a gripper, the gripper being arranged to selectively grip and release the drilling expendables and to move between a first position facing a supply magazine holding the drilling expendables and a second position facing the drill head, wherein the manipulator is arranged to automatically take a drilling expendable from the supply magazine and to return the drilling expendable thereto, and insert the drilling expendable into the drill head and to remove the drilling expendable therefrom, and a translation mechanism arranged to move the gripper in a longitudinal direction, the translation mechanism including a slanted groove and a projecting member slidably engaging said groove, the groove or the projecting, member being associated with the gripper; and a supply device including a supply magazine having a plurality of holders for the drilling expendables, wherein each holder of the supply magazine is arranged to accommodate differently-sized drilling expendables selected from the group of drill steels, rebar bolts, and resin cartridges.

* * * * *